US006886382B1

(12) United States Patent
St. Felix

(10) Patent No.: US 6,886,382 B1
(45) Date of Patent: May 3, 2005

(54) KEY WITH INDICATOR

(76) Inventor: Harold St. Felix, 4907 Pine Knott La., West Palm Beach, FL (US) 33417

( * ) Notice: Subject to any disclaimer, the term of this patent is extended or adjusted under 35 U.S.C. 154(b) by 0 days.

(21) Appl. No.: 10/836,493

(22) Filed: Apr. 30, 2004

(51) Int. Cl.[7] ..... E05B 41/00

(52) U.S. Cl. ..... 70/432; 70/395; 70/408; 70/423

(58) Field of Search ..... 70/393, 395, 398, 70/401, 408, 456 R, 432, 441, 423, 427

(56) References Cited

U.S. PATENT DOCUMENTS

| | | | | | |
|---|---|---|---|---|---|
| 14,958 | A | * | 5/1856 | Hendrickson | 70/365 |
| 468,807 | A | * | 2/1892 | Kinter | 70/276 |
| 592,300 | A | * | 10/1897 | Lyon | 70/423 |
| 1,237,115 | A | * | 8/1917 | Stein | 70/395 |
| 1,843,335 | A | * | 2/1932 | Oberfield | 70/395 |
| 2,176,465 | A | * | 10/1939 | Merkl | 70/395 |
| 2,198,484 | A | * | 4/1940 | Merkl | 70/395 |
| 2,418,046 | A | * | 3/1947 | Oberfield | 70/395 |
| 2,561,944 | A | * | 7/1951 | Oberfield | 70/395 |
| 4,107,967 | A | * | 8/1978 | Grabb | 70/427 |
| 4,292,995 | A | * | 10/1981 | Mazzola | 137/384.2 |
| 4,432,218 | A | | 2/1984 | Hoener | 70/395 |
| 4,440,011 | A | * | 4/1984 | Klein | 70/438 |
| 4,557,123 | A | * | 12/1985 | Marks et al. | 70/395 |
| 4,631,943 | A | * | 12/1986 | Hoener | 70/395 |
| 4,732,024 | A | * | 3/1988 | Nagy | 70/427 |
| 4,936,896 | A | | 6/1990 | Takatsuka | 70/432 |
| 5,435,160 | A | * | 7/1995 | Linsalato et al. | 70/408 |
| 5,440,909 | A | * | 8/1995 | Ely et al. | 70/395 |
| 5,548,984 | A | | 8/1996 | Miyatsu | 70/276 |
| 5,671,624 | A | * | 9/1997 | Sivils | 70/408 |
| 5,870,917 | A | | 2/1999 | Mahot et al. | 70/408 |
| 6,255,957 | B1 | * | 7/2001 | Sonderegger et al. | 340/686.1 |
| 6,354,122 | B1 | | 3/2002 | Snoke | 70/432 |
| 6,575,005 | B1 | * | 6/2003 | Hunter | 70/432 |
| 6,610,947 | B2 | * | 8/2003 | Campana et al. | 200/336 |
| 2002/0014098 | A1 | * | 2/2002 | Cowan et al. | 70/408 |
| 2004/0103702 | A1 | * | 6/2004 | Abeler | 70/408 |

* cited by examiner

*Primary Examiner*—Suzanne Dino Barrett
(74) *Attorney, Agent, or Firm*—Robert C. Kain, Jr.; Fleit Kain

(57) ABSTRACT

The key with a lock-unlock indicator is operable with a complementary lock set. The key has a body and an elongated key stem extending therefrom. A toggle bar is pivotally mounted or disposed on the key stem. The toggle bar operates in conjunction with a lock cam and an unlock cam mounted on the face of the complementary lock set. When the operator turns the key in one direction, the lock cam motivates the toggle bar thereby shifting its position. An indicator disposed in the key body displaying a lock condition and an unlock condition.

16 Claims, 1 Drawing Sheet

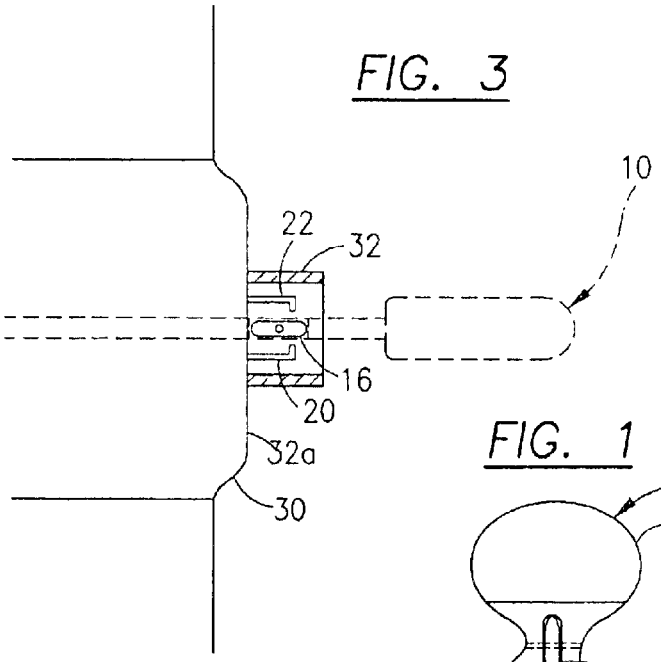
FIG. 3
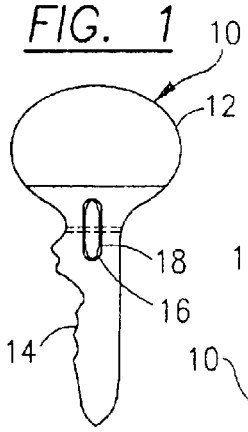
FIG. 1
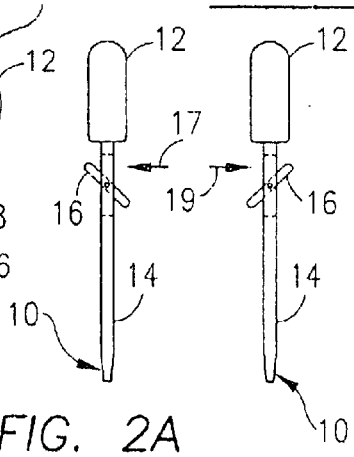
FIG. 2B
FIG. 2A
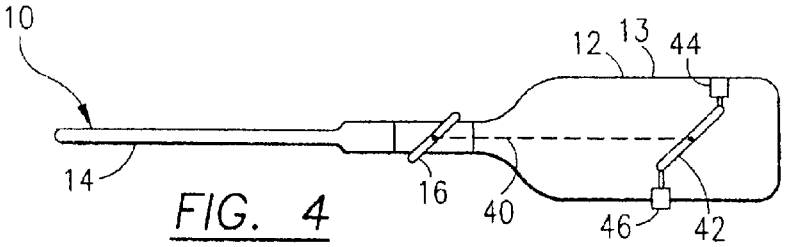
FIG. 4
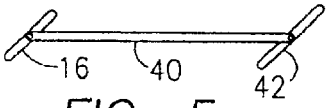
FIG. 5
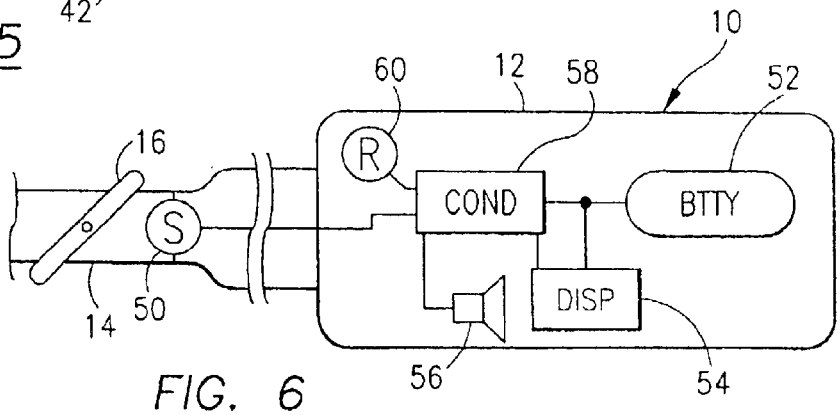
FIG. 6

KEY WITH INDICATOR

The present invention relates to a key with a lock-unlock indicator, wherein the key is operable with a complementary lock set.

BACKGROUND OF THE INVENTION

There are several patent disclosures having keys with a lock and an unlock indicator. See for example U.S. Pat. Nos. 5,870,917; 4,432,218; 4,936,896; 5,548,984 and 6,354,122.

There is a need for a key with a simple lock-unlock indicator such that persons can visually confirm that the operator has locked a complementary lock set by simply viewing the base of the key. Additionally, an audible indicator announcing a lock or unlock condition is sometimes useful.

OBJECTS OF THE INVENTION

It is an object of the present invention to provide a key with a lock-unlock indicator.

It is another object of the present invention to provide a visual lock-unlock indicator on the base of the key.

It is a further object of the present invention to provide an audible lock-unlock indicator on the key.

SUMMARY OF THE INVENTION

The key with a lock-unlock indicator is operable with a complementary lock set. The key has a body and an elongated key stem extending therefrom. A toggle bar is pivotally mounted or disposed on the key stem. The toggle bar operates in conjunction with a lock cam and an unlock cam mounted on the face of the complementary lock set. When the operator turns the key in one direction, the lock cam motivates the toggle bar thereby shifting its position. An indicator disposed in the key body displaying a lock condition and an unlock condition.

BRIEF DESCRIPTION OF THE DRAWINGS

Further objects and advantages of the present invention can be found in the detailed description of the preferred embodiments when taken in conjunction with the accompanying drawings in which:

FIG. 1 diagrammatically illustrates the key with a toggle bar;

FIGS. 2A and 2B diagrammatically illustrate a side view of the key showing the toggle bar in a locked condition and in an unlocked condition;

FIG. 3 diagrammatically illustrates the complementary key set, locking and unlocking cams and a key shown in dashed lines;

FIG. 4 diagrammatically illustrates the key, the toggle bar, the operative coupling and a lock-unlock indicator;

FIG. 5 diagrammatically illustrates one mechanism for the coupling the toggle with the actuator for the indicator; and FIG. 6 diagrammatically illustrates an electronic system displaying the lock-unlock condition in the key body.

DETAILED DESCRIPTION OF THE PREFERRED EMBODIMENTS

The present invention relates to key with a lock-unlock indicator operable with a complementary lock set. In the figures, similar numerals designate similar items.

FIG. 1 diagrammatically illustrates key 10 having a key base 12 with a key stem 14. A toggle bar 16 is pivotally mounted in opening or space 18 of stem 14.

FIG. 2A shows key 10 in an unlocked condition caused when an unlocking cam 20 (FIG. 3) motivates toggle 16 in the direction shown by arrow 17. FIG. 2B diagrammatically shows key 10 in a locked position when toggle 16 is moved in direction 19 by a lock cam 22 (FIG. 3).

FIG. 3 diagrammatically shows a complementary lock set 30 having a face 32*a* and a lock cam 22 and an unlock cam 20. The cams 22, 20 are shielded by an open ended shield 32 mounted on face 32*a* of lock set 30. Key 10 is inserted into the lock set 30 thereby causing the lock to lock or unlock. Toggle 16 is motivated to show the locked condition (FIG. 2B) or the unlocked condition (FIG. 2A) based upon locking cam 22 and unlocking cam 20. As shown in FIG. 3, toggle 16 is in a neutral position.

FIG. 4 diagrammatically shows, in a schematic form, toggle bar 16 pivotally mounted in key stem 14. An operational coupling 40 connects toggle 16 with, in the embodiment illustrated in FIG. 4, an actuator toggle 42. Actuator toggle 42 includes locked and unlocked display buttons 44, 46 which visually present to the user the locked or unlocked condition of lock set 30. Display button 46 protrudes from key body 12 indicating a unlocked condition. When toggle 16 is in a position 90 degrees rotated from its illustrated position, lock display button 44 protrudes from the side 13 of key body 12. The display buttons 44, 46 may be color coded to enhance their visual presentation to the user. Additionally, an audible "click" can be mechanically incorporated therein such that when toggle bar 16 moves from the illustrated position to the locked position 90 degrees rotated from that shown in FIG. 4, actuator toggle 42 passes a mechanical click system audibly announcing to the user that the key has been locked.

FIG. 5 diagrammatically shows that the operative coupling 40 can be a mechanical chain, belt or linkage coupling toggle bar 16 to actuator toggle 42. The linkage may include two (2) independent wires or lines on opposite sides of the pivot points for toggle bar 16 and actuator toggle 42.

FIG. 6 diagrammatically illustrates an electronic lock-unlock indicator. Toggle 16 operates electrical switch 50 when the toggle 16 passes the switch. For example, a rocker switch or a other micro switch may be utilized on key stem 14 proximate the toggle and key body 12. Disposed in key body 12 is a battery 52; a visual display unit 54, and audible announcer 56, a signal conditioning circuit 58, and a reset button 60. Switch 50 is connected to the signal conditioner 58. The signal conditioner generates appropriate electronic signals to operate display 54 and audible announcer (speaker) 56. Display 54 shows a locked or unlocked word, symbol or color. Reset switch 60 permits the operator to reset the signal conditioner if the key body 12 erroneously indicates a locked or unlocked condition. Battery 52 is replaceable. Display 54 is visible to the user. Display 54 may be on an edge of the key or may be on either side or the back end of the key body.

The claims appended hereto are meant to cover modifications and changes within the scope and spirit of the present invention.

What is claimed is:

1. A key with a lock-unlock indicator, said key operable with a complementary lock set comprising:

a key having a body and an elongated key stem longitudinally extending from said key body;

a toggle bar pivotally disposed on said key stem;

an indicator disposed in said key body, said indicator displaying a locked condition and an unlocked condition;

means for operatively coupling said toggle bar with said indicator; and a lock cam and an unlock cam mounted on said complementary lock set such that upon insertion of said key stem into said lock set and rotation of said key therein, one or the other of said lock cam and unlock cam motivates said toggle thereby changing said indicator displaying the corresponding locked condition and unlocked condition;

wherein said means for operatively coupling is a mechanical chain, belt or linkage coupling said toggle bar and said indicator.

2. A key operable with complementary lock set as claimed in claim 1 wherein said lock cam and unlock cam is mounted on an exposed face of said lock set within an open ended shield mounted on said lock set.

3. A key operable with complementary lock set as claimed in claim 1 wherein said indicator includes an actuator toggle having a first and a second end and a lock display button and an unlock display button respectively coupled to said first and said second end of said actuator toggle.

4. A key operable with complementary lock set as claimed in claim 3 wherein said actuator toggle coupled to said toggle bar via said mechanical chain, belt or linkage.

5. A key operable with complementary lock set as claimed in claim 1 wherein said lock cam and unlock cam is mounted on an exposed face of said lock set within an open ended shield mounted on said lock set, said shield being generally cylindrical.

6. A key operable with complementary lock set as claimed in claim 1 wherein said indicator includes a battery powered display.

7. A key operable with complementary lock set as claimed in claim 6 wherein said lock cam and unlock cam is mounted on an exposed face of said lock set within an open ended shield mounted on said lock set.

8. A key operable with complementary lock set as claimed in claim 7 including an audible indicator for announcing said locked and unlocked condition.

9. A key operable with complementary lock set as claimed in claim 7 including an audible indicator for announcing said locked and unlocked condition.

10. A key with a lock-unlock indicator, said key operable with a complementary lock set comprising:

a key having a body and an elongated key stem longitudinally extending from said key body;

a toggle bar pivotally disposed on said key stem;

an indicator disposed in said key body, said indicator displaying a locked condition and an unlocked condition;

means for operatively coupling said toggle bar with said indicator; and a lock cam and an unlock cam mounted on said complementary lock set such that upon insertion of said key stem into said lock set and rotation of said key therein, one or the other of said lock cam and unlock cam motivates said toggle thereby changing said indicator displaying the corresponding locked condition and unlocked condition;

wherein said indicator includes a battery powered display and said means for operatively coupling includes a switch and an electrical coupling between said switch and said display.

11. A key operable with complementary lock set as claimed in claim 10 wherein said lock cam and unlock cam is mounted on an exposed face of said lock set within an open ended shield mounted on said lock set.

12. A key operable with complementary lock set as claimed in claim 10 wherein said lock cam and unlock cam is mounted on an exposed face of said lock set within an open ended shield mounted on said lock set, said shield being generally cylindrical.

13. A key operable with complementary lock set as claimed in claim 10 wherein said switch is a rocker switch.

14. A key operable with complementary lock set as claimed in claim 13 wherein said lock cam and unlock cam is mounted on an exposed face of said lock set within an open ended shield mounted on said lock set.

15. A key operable with complementary lock set as claimed in claim 10 including an audible indicator for announcing said locked and unlocked condition.

16. A key operable with complementary lock set as claimed in claim 15 including an audible indicator for announcing said locked and unlocked condition.

* * * * *